US005938484A

United States Patent [19]

Beege et al.

[11] Patent Number: 5,938,484

[45] Date of Patent: Aug. 17, 1999

[54] RESILIENT TERMINAL MEANS INCLUDING SHARP CONDUCTOR-RETAINING EDGES

[75] Inventors: Werner Beege, Hainburg; Reinhard Ruhm, Pfungstadt; Jürgen Ude, Breuberg, all of Germany

[73] Assignee: Weidmuller Interface GmbH & Co., Detmold, Germany

[21] Appl. No.: 08/911,363

[22] Filed: Aug. 7, 1997

[30] Foreign Application Priority Data

Aug. 9, 1996 [DE] Germany ..... 196 32 187

[51] Int. Cl.[6] ..... H01R 4/48

[52] U.S. Cl. ..... 439/828

[58] Field of Search ..... 439/828, 835, 439/836, 436, 435, 441

[56] References Cited

U.S. PATENT DOCUMENTS

| | | | |
|---|---|---|---|
| 3,622,955 | 11/1971 | Fernex | 439/828 |
| 4,768,981 | 9/1988 | Hohorst | 439/828 |
| 5,679,021 | 10/1997 | Krämer | 439/828 |
| 5,860,837 | 1/1999 | Böck et al. | 439/828 |

FOREIGN PATENT DOCUMENTS 3911 457 A1 10/1990 Germany .

*Primary Examiner*—Paula Bradley
*Assistant Examiner*—Tho D. Ta
*Attorney, Agent, or Firm*—Laubscher & Laubscher

[57] ABSTRACT

A resilient electrical terminal includes a loop-shaped conductive resilient compression spring having a body portion, a clamping leg portion extending generally normal to said body portion, and a contact leg portion extending generally normal to said clamping leg portion, said clamping leg portion containing a window opening, and an electrically conductive bus bar arranged parallel with and adjacent said contact leg portion on the side thereof remote from said spring body portion, said bus bar extending at one end through said window opening, the free extremity of said spring clamping leg portion being bent adjacent the window through an acute angle relative to the axis of the clamping leg portion to cause the wall portion of the window opening remote from the spring body portion, thereby to define a first sharp edge, whereby when a conductor is inserted in the window opening between the bus bar and the window wall portion, the sharp edge digs into the adjacent peripheral portion of the conductor to inhibit removal thereof through said window. A similar second sharp edge is provided on a punched-out tongue portion of the bus bar for also digging into the periphery of the conductor to prevent removal thereof from said window.

3 Claims, 2 Drawing Sheets

RESILIENT TERMINAL MEANS INCLUDING SHARP CONDUCTOR-RETAINING EDGES

BACKGROUND OF THE INVENTION

1. Field of the Invention

A resilient electrical terminal assembly includes a loop-shaped conductive spring having body, clamping leg and contact leg portions, and a bus bar extending at one end through a window opening contained in the spring clamping leg, the terminal portion of the clamping leg adjacent the window being bent to define a sharp edge that digs into the peripheral surface of a conductor inserted into the window, thereby to inhibit removal of the conductor from the window.

2. Description of the Prior Art

Spring terminals for connecting an electrical conductor to a load device are well known in the prior art, as evidenced, for example, by the Published German Application No. 39 11 459. As distinguished from the screw type of connector, these spring terminals offer the advantage of quick simple connection without the necessity of auxiliary manual tools. As is known in these spring terminals, the clamping leg of the spring terminal exerts a uniform pressure on the conductor, thereby resisting removal of the conductor from the terminal. Moreover, it is often required to provide a gas-proof connection between the spring and associated bus bar members and the conductor, something that is achieved not only by the spring forces that have to be provided, but also by the corresponding design in the area of contact with the conductor. In such spring terminals, the highest possible surface pressure is normally desired without undue damage to the conductor. With the advent of smaller spring terminals, the spring force of the spring cannot be increased disproportionately, so that the only alternative is to minimize the pressure surfaces in order to increase the surface pressure, while at the same time achieve the aforementioned gas-proof connection.

The present invention was developed to provide an improved spring terminal assembly in which the surface pressure between the compression spring and/or the bus bar and the conductor will be as great as possible, on the one hand, while maintaining the compression force of the spring unchanged, even in the case of the very smallest of terminals.

SUMMARY OF THE INVENTION

Accordingly, a primary object of the present invention is to provide a spring terminal in which the free extremity of the clamping leg of a loop-shaped spring terminal is bent adjacent the window opening contained therein at an acute angle relative to the axis of the clamping leg, thereby to define on the wall portion of the window that engages the periphery of the conductor a first sharp edge that digs into the conductor, thereby to prevent the withdrawal of the conductor from the window opening. Owing to the small area provided by the sharp edge, a relatively high clamping force is produced from a given spring terminal that is a multiple of the force produced by the prior terminals.

According to another object of the invention, the bus bar includes a punched-out tongue portion which has a second sharp edge for engaging the periphery of the conductor at a point on the opposite side of, and longitudinally spaced from, the first sharp edge, thereby to further inhibit withdrawal of the conductor from the window.

BRIEF DESCRIPTION OF THE DRAWING

Other objects and advantages of the invention will become apparent from a study of the following specification, when viewed in the light of the accompanying drawing, in which.

DETAILED DESCRIPTION

Figure 1:
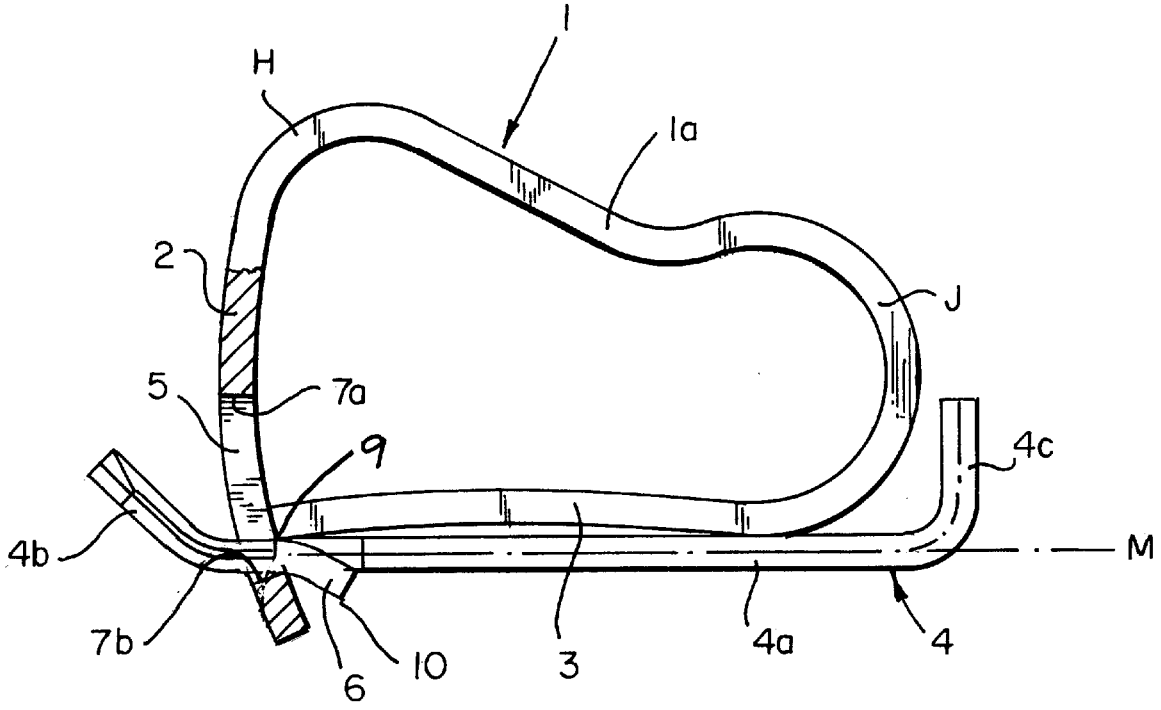
FIG. 1 is a side elevation view of the electrical spring terminal assembly of the present invention.

Referring first more particularly to FIG. 1, the electrical terminal assembly includes a generally loop-shaped conductive metal compression spring 1 having a body portion 1*a*, a clamping leg portion 2 that extends from a first juncture H generally normal to the body portion, and a contact leg portion 3 that extends at an acute angle relative to the body portion 1*a* toward a position generally normal to the clamping leg portion 2. The window opening 5 has a pair of opposed parallel wall surfaces 7*a* and 7*b* adjacent and remote from said first juncture H, respectively. Conductive metal bus bar 4 is provided having a body portion 4*a* parallel with and adjacent the contact leg portion 3, a first end portion 4*b* that extends through the window opening 5, and a second end portion 4*c* that is bent orthogonally upwardly adjacent the second juncture J between the body and clamping leg portions of the spring 1.

Figure 2:
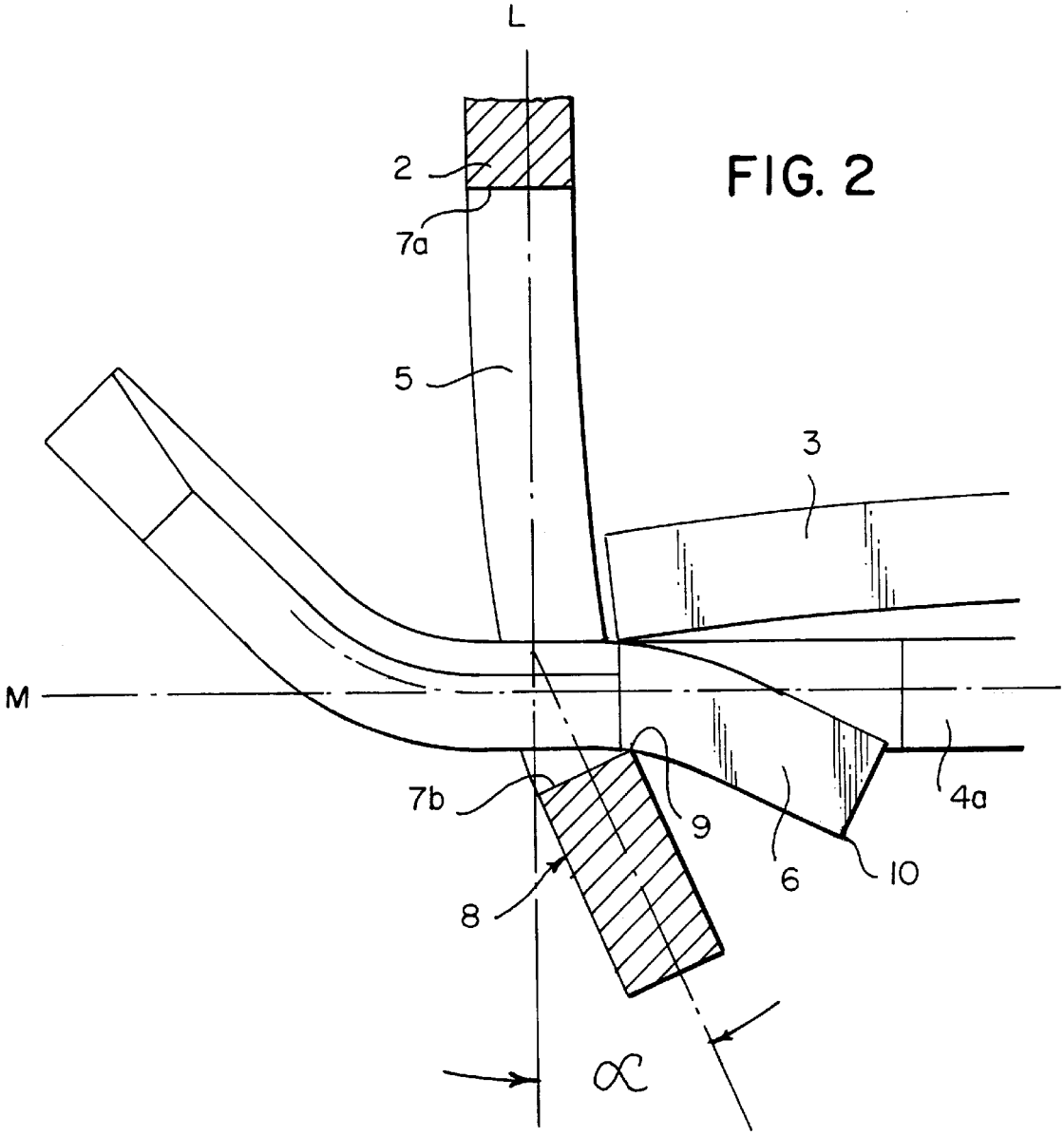
FIG. 2 is a detailed view of the sharp edges formed on the wall of the window opening of the bent clamping leg.
Figure 3:
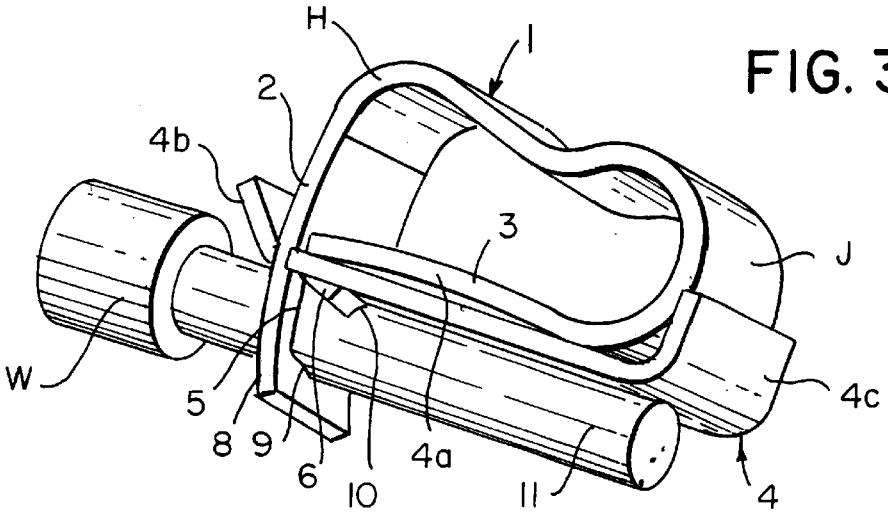
FIG. 3 is a perspective view of the electrical spring terminal of the present invention attached to the protruding bare wire conductor of an insulated wire.

Referring to FIG. 2, according to a characterizing feature of the invention, the free end or terminal portion 8 of the clamping leg portion 2 is bent adjacent the window 5 through an acute angle $\alpha$ relative to the axis longitudinal axis L of the clamping leg portion 2, thereby to cause the wall surface 7*b* of the window opening remote from the first juncture H and the spring body 1*a* to be inclined, whereby a first sharp edge 9 is defined on the clamping leg adjacent the bus bar 4. Furthermore, the bus bar body portion 4*a* contains adjacent the window 5 a downwardly bent cut- out tongue portion 6 extends toward the bus bar second end portion 4*c* and that defines at its free end a second sharp edge 10 that is longitudinally spaced from the first sharp edge 9 relative to the longitudinal axis M of the bus bar body portion 4*a*. Thus, as shown in FIG. 3, when the bus bar 4 and the spring contact leg portion 3 are displaced toward the spring body portion 1*a*, the bare conductor end portion 11 of an insulated wire W may be inserted into the window opening into adjacent parallel electrical contact with the bus bar body portion 4. Owing to the resilient restoring force of the spring terminal, the conductor 11 is biased downwardly into electrical engagement with the first sharp edge 9 which will dig into the lower peripheral surface of the conductor to inhibit withdrawal of the conductor from the window. Similarly, the bus bar 4 is biased downwardly to cause the second sharp edge 10 to dig into the upper peripheral surface of the conductor, thereby to further inhibit the withdrawal of the conductor from the window. This retaining function of the sharp edges 9 and 10 is particularly effective when the conductor 11 is formed from a relative soft conductive metal, such as copper or aluminum. Since the sharp edges 9 and 10 are longitudinally displaced relative to the conductor 11, it is not wholly or partly severed or weakened to any major extent. The angle of inclination $\alpha$ may be varied in accordance with the particular requirements desired, and with the cross-sectional size of the conductor. Preferably, the direction of bend of the clamping leg terminal portion 8 and the direction of bend of the tongue 6 relative to the axis of the bus bar 4 correspond with the direction of the free extremity 11*a* of the conductor 11 (i.e., in the direction of the bus bar second end portion 4*c*).

While in accordance with the provisions of the Patent Statutes the preferred forms and embodiments of the invention have been illustrated and described, it will be apparent that various changes and modifications may be made without deviating from the inventive concepts set forth above.

What is claimed is:

1. Resilient electrical terminal means adapted for connection with electrical conductors, and the like, comprising:

(a) a resilient generally loop-shaped conductive metal compression spring (1) having a body portion (1*a*), a clamping leg portion (2) connected with one end of said body portion to define a first juncture (H) and extending generally normal to said spring body portion, and a contact leg portion (3) connected with the other end of said body portion to define a second juncture (J), said clamping portion containing a generally rectangular window opening (5) having first (7*a*) and second (7*b*) opposed side wall surfaces adjacent and remote from said first juncture (H), respectively; and (b) a conductive metal bus bar (4) having a central body portion (4*a*), and first (4*b*) and second (4*c*) end portions, said bus bar being arranged with its central body portion generally parallel with said spring contact leg portion on the opposite side thereof from said spring body portion, whereby said contact leg portion biases said bus bar toward said second window side wall surface;

(c) said spring clamping leg portion having a first longitudinal axis (L), and an end extremity (8) that is bent from a bending location adjacent said second window side wall surface in the direction of said second juncture through an acute angle ($\alpha$) relative to said longitudinal axis, thereby to cause said second window side wall surface to be inclined relative to said first window side wall surface and to define a first sharp edge (9) adjacent said bus bar, whereby when a conductor (11) is inserted through said window in one direction toward said second juncture (J), said first sharp edge will engage the conductor to inhibit the displacement thereof in the opposite direction.

2. Resilient electrical terminal means adapted for connection with electrical conductors, and the like, comprising:

(a) a resilient generally loop-shaped conductive metal compression spring (1) having a body portion (1*a*), a clamping leg portion (2) connected with one end of said body portion to define a first juncture (H) and extending generally normal to said spring body portion, and a contact leg portion (3) connected with the other end of said body portion to define a second juncture J, said clamping portion containing a generally rectangular window opening (5) having first (7*a*) and second (7*b*) opposed side wall surfaces adjacent and remote from said first juncture (H), respectively; and (b) a conductive metal bus bar (4) having a central body portion (4*a*), and first (4*b*) and second (4*c*) end portions, said bus bar being arranged with its central body portion generally parallel with said spring contact leg portion on the opposite side thereof from said spring body portion, whereby said contact leg portion biases said bus bar toward said second window side wall surface;

(c) said spring clamping leg portion having a first longitudinal axis (L), and an end extremity (8) that is bent from a bending location adjacent said second window side wall surface in the direction of said second juncture through an acute angle ($\alpha$) relative to said longitudinal axis, thereby to cause said second window side wall surface to be inclined relative to said first window side wall surface and to define a first sharp edge (9) adjacent said bus bar;

(d) said bus bar central body portion containing adjacent said window opening a punched tongue portion (6) that extends longitudinally of said central body portion toward said second end portion thereof, and outwardly in the direction away from said spring contact leg portion, said tongue portion terminating in a second sharp edge (10), whereby when a conductor (11) is inserted through said window in one direction toward said second juncture (J), said first and second sharp edges will engage the periphery of the conductor to inhibit the displacement thereof in the opposite direction.

3. Resilient electrical terminal means as defined in claim 2, wherein said first and second sharp edges are longitudinally displaced relative to the axis (M) of said bus bar means.

* * * * *